United States Patent [19]

Bursani

[11] 4,057,873

[45] Nov. 15, 1977

[54] DOOR HINGE COUPLING DEVICE

[76] Inventor: Rudolph Bursani, 3735 69th Way North, St. Petersburg, Fla. 33710

[21] Appl. No.: 670,406

[22] Filed: Mar. 25, 1976

[51] Int. Cl.[2] ..... E05D 11/00

[52] U.S. Cl. ..... 16/137

[58] Field of Search ..... 16/128 R, 137, 147

[56] References Cited

U.S. PATENT DOCUMENTS

| | | | |
|---|---|---|---|
| 905,201 | 12/1908 | Magnnsen | 16/137 |
| 1,391,304 | 9/1921 | Dowling | 16/137 |
| 1,612,656 | 12/1926 | Salin | 16/128 R |
| 1,895,495 | 1/1933 | Steele | 16/137 X |
| 1,923,721 | 8/1933 | Glenn | 16/137 |
| 2,797,432 | 7/1957 | Gakle | 16/137 |
| 2,810,152 | 10/1957 | Bruno | 16/137 X |
| 3,510,906 | 5/1970 | Baldwin | 16/128 R |

*Primary Examiner*—G. V. Larkin

*Attorney, Agent, or Firm*—Mason, Mason & Albright

[57] ABSTRACT

Projections in door hinge plates penetrate and bear against cooperating slots in opposite plates of door hinges to prevent a locked door from being removed from a doorjamb by removing the hinge pintles.

2 Claims, 3 Drawing Figures

DOOR HINGE COUPLING DEVICE

BACKGROUND OF THE INVENTION

1. Field of the Invention

The present invention relates to door hinges and more particularly to a door hinge structure which cannot be disassembled when the hinge is in its closed position.

2. Description of the Prior Art

Hinges consisting of two hinge plates having staggered cooperating sockets on one edge of each and a pin or pintle placed through the sockets are quite old in the art. When one hinge plate is secured to a doorjamb and the other plate is secured to the surface edge of a door, the two flanges parallel each other when the door is in its closed position. In the past, various types of projections have been secured to one flange which penetrated a recess on the other flange as a hinge is moved into its parallel or closed position. R. Salin nee Levy, U.S. Pat. No. 1,612,656 discloses a tapered projection of metal or of any other hard or flexible substance such as hard rubber, which penetrates a tapered hole in the adjoining flange plate to prevent jarring or rattling of doors such as the doors of motor vehicles. D. Skidmore, U.S. Pat. No. 167,576 discloses a stud secured to one hinge plate which as the hinge closes engages a cushion in a recess of the other hinge plate to deaden or prevent door closure noise. C. F. Mink, U.S. Pat. No. 2,058,341 discloses a tapered edge hinge plate which penetrates a receiving depressed bevel edged hinge plate, to effect a centering action when the door wing and doorjamb wing are folded together.

Therefore, projections on one hinge plate which enter a recess in the other hinge plate as the hinge is moved to the closed position have been utilized for centering, for preventing rattling, and for cushioning, but construction of this type which affords a rigid interconnection of hinge plates has never been used to prevent breaking and entering through a doorway.

SUMMARY OF THE INVENTION

The present invention utilizes a projection on one hinge plate of a hinge which enters a recess in the other hinge plate for the purpose of preventing parallel movement of one hinge plate in relationship to the other when the pintle or pin of the hinge has been removed and force is applied to the hinge or door in an effort to remove a locked door. In order to prevent such breaking and entering, the projection of the present invention forms either a right angle or an acute angle towards the hinge pintle, contacts the edge of the recess closest to the pintle when the hinge is closed, and extends a substantial distance through the recess in the other hinge plate. These features of the present invention were not found in the prior art.

It is therefore an object of the present invention to provide a new and improved door hinge.

Another object is to provide a door hinge having a projection on one hinge plate of a hinge which enters a recess on the other hinge plate of the hinge when the hinge is closed to prevent the parallel movement of the projecting hinge plate relative to the recessed hinge plate even when the hinge pintle has been removed.

Yet another object is to position the aforementioned projection at an angle which is no greater than 90° to the flange plate toward the hinge pintle in a plane which is perpendicular to the hinge pintle.

BRIEF DESCRIPTION OF THE DRAWINGS

Further objects and advantages will become apparent from the following detailed description taken in connection with the accompanying drawings, in which.

DESCRIPTION OF THE PREFERRED EMBODIMENTS

Figure 1:
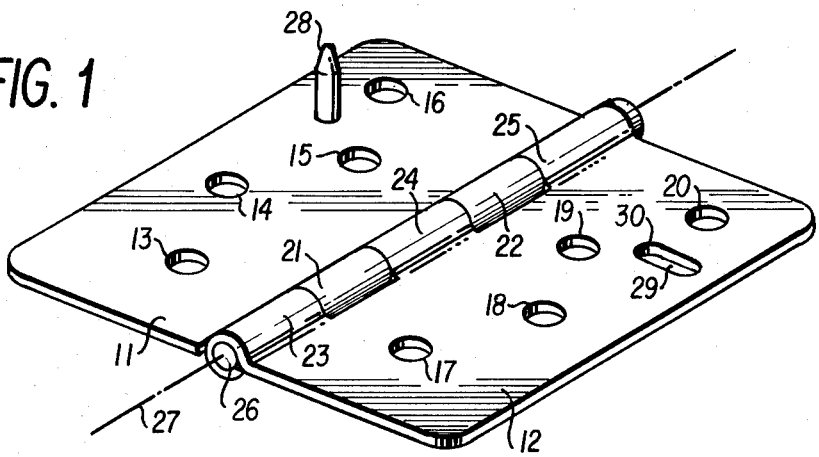
FIG. 1 is a perspective drawing of a preferred embodiment of the present invention.

While this invention is susceptible of the embodiment in many different forms, there is shown in the drawings and will herein be described in detail, embodiments of the invention with the understanding that the present disclosures are to be considered as exemplifications of the principles of the present invention and are not intended to limit the invention to the embodiments illustrated. The scope of the invention will be pointed out in the appended claims.

Referring to FIG. 1, a butt hinge has hinge plates 11 and 12 with fastener apertures 13–20 respectively. Hinge plate 11 has sockets 21 and 22 formed in one edge thereof and hinge plate 12 has sockets 23–25 formed in one edge thereof. A pin or pintle 26 is inserted through the sockets 21–25 for relative rotational movement of the hinge plates. A line 27 is the pintle center axis of the pin 26.

A stud or bolt 28 is welded, threaded or riveted to hinge plate 11 at a right angle. A cooperating elongated slot 29, having an end surface 30, is formed in hinge plate 12 to receive stud 28 when the hinge is closed. The outer end of stud 28 is at a greater distance from the pintle axis 27 than its base. Therefore, as the hinge is rotated to the closed position the end of the bolt passes through the slot at a point away from the axis 27 and the stud 28 approaches slot end surface 30 as the hinge is closed until a solid or substantial contact is made between stud 28 and surface 30. In mounting the hinge illustrated in FIG. 1, the hinge plate 11 is secured to the edge of a door (not shown) and the hinge plate 12 is secured to a doorjamb.

When the hinge is thus mounted the pin or pintle 26 may be removed, but plate 11 cannot be slid to the left to remove the door since bolt or stud 28 is penetrating through the slot 28 and is abutting end surface 30 of the slot 29. Thus when the door is locked and hinges of this type as shown in FIG. 1 are employed to hang the door, pintle or pin removal will not allow the door to be unhinged. Stud 28 is preferably constructed of case hardened steel for the purpose of making it difficult to cut with a hacksaw blade or similar instrument.

Figure 2:
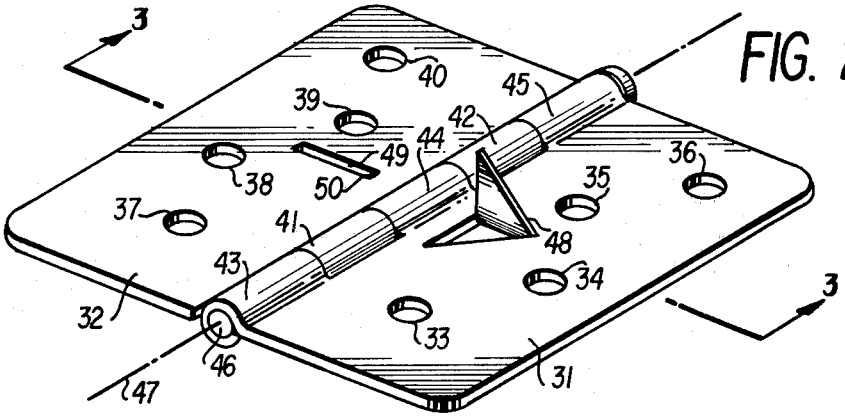
FIG. 2 is a perspective drawing of a modification of the embodiment of the invention illustrated in FIG. 1.

FIG. 2 is a modification of the preferred embodiment illustrated in FIG. 1, wherein the projection from one plate is a lug stamped from the plate and bent outwardly. Hinge plate 31 has fastener apertures 33–36 and a cooperating hinge plate 32 has fastener apertures 37–40. The flange plate 31 has sockets 41 and 42 formed in one edge thereof. The hinge plate 32 has cooperating sockets 43–45 formed in one edge thereof. A pin or pintle 46 is inserted through the sockets 41–45 to provide for the rotational movement of the hinge plates 31 and 32 about a pintle center axis 47.

A projection 48 is stamped from the plate 31 and then bent upward until it lies in a plane perpendicular to pintle axis 47. A slot 49 has an inner end surface 50 adjacent axis 47 as may best be seen in FIG. 3. A tip 51 of projection 48 will follow the dash line 52 as the hinge is closed. A base surface section 53 will follow the dash line 54 as the hinge is closed and will solidly or substantially engage slot surface 50 when the hinge is fully closed.

Figure 3:
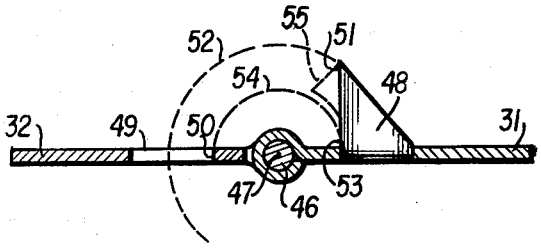
FIG. 3 is a sectional drawing of the embodiment illustrated in FIG. 2 taken along the line 3—3.

As illustrated in FIG. 3, the section 53 and the entire leading edge of the projection 48 can be angled forward towards the pintle axis 47, as for example, along the dash lines 55. With this form of construction, projection 48 would then provide an acute angle latch which could force the section 53 even more solidly against the inner end of the slot 50.

The projection of the projections 28 and 48 a substantial distance through the apertures in the opposing hinge plate assures that a door cannot be joggled after the pintles are removed from the hinges to the point where the projections can be pulled out of the apertures.

As will be recognized by those skilled in the art, when hinges of the type described are open, the pintles may be removed and doors unhinged in the conventional manner.

I claim:

1. In a hinge of the type having two hinge plates pivotally connected about a pintle axis to each other by a pin, the improvement which comprises, an elongated slot of uniform width having opposite ends with a longitudinal axis formed in one of said hinge plates, said axis being perpendicular to said pintle axis, and a projection bent outwardly from said other hinge plate along a line perpendicular to said pintle axis to extend normally therefrom penetrating said slot to bear firmly against both ends of said slot whenever said hinge is closed, whereby said projection has two oppositely disposed contacting surfaces, one contacting surface being no greater than a right angle and the angle of the second contacting surface being an acute angle relative to said other hinge plate, both said contacting surfaces bearing against opposite ends of said slot when said hinge is closed.

2. A hinge as specified in claim 1, wherein said projection extends substantially beyond said slot when said hinge is closed.

* * * * *